US009863119B2

(12) United States Patent
Congdon et al.

(10) Patent No.: US 9,863,119 B2
(45) Date of Patent: Jan. 9, 2018

(54) WEAR MEMBER

(71) Applicant: Caterpillar Inc., Peoria, IL (US)

(72) Inventors: Thomas M. Congdon, Dunlap, IL (US); Susan Graham, Peoria, IL (US); Bart A. Fisher, Roanoke, IL (US)

(73) Assignee: Caterpillar Inc., Peoria, IL (US)

( * ) Notice: Subject to any disclaimer, the term of this patent is extended or adjusted under 35 U.S.C. 154(b) by 156 days.

(21) Appl. No.: 14/936,322

(22) Filed: Nov. 9, 2015

(65) Prior Publication Data

US 2017/0130423 A1 May 11, 2017

(51) Int. Cl.
*E02F 3/815* (2006.01)
*E02F 9/28* (2006.01)

(52) U.S. Cl.
CPC ..... *E02F 3/8152* (2013.01); *E02F 9/2883* (2013.01)

(58) Field of Classification Search
CPC ..... E02F 3/8152; E02F 9/28; E02F 9/2883
USPC ..... 172/719, 772, 772.5; 89/36.02; 404/18, 404/28, 29, 31, 32, 33, 35, 37, 38, 39
See application file for complete search history.

(56) References Cited

U.S. PATENT DOCUMENTS 2,189,218 A * 2/1940 Neumeister ..... E04F 13/08 52/591.2
3,971,323 A * 7/1976 Beiswenger ..... E01B 27/12 104/10
4,090,338 A * 5/1978 Bourgade ..... E04F 15/022 52/392
4,290,214 A 9/1981 Stepe
5,261,170 A * 11/1993 Ward ..... E02F 3/401 172/772.5
5,316,408 A * 5/1994 Stanley ..... E01C 9/086 15/215
5,396,963 A * 3/1995 Curry ..... E02F 3/8152 172/701.3
6,694,682 B2 * 2/2004 Fanti ..... B32B 3/14 52/177
7,874,085 B1 * 1/2011 Winter ..... E01H 5/061 172/701.3
8,266,849 B2 * 9/2012 Bravo ..... E04F 15/043 52/177
8,795,828 B2 8/2014 Grozdanich et al.
9,163,379 B2 * 10/2015 Winter ..... E01H 5/061
(Continued)

FOREIGN PATENT DOCUMENTS

EP 0442449 8/1991
JP 2002-371782 A 12/2002
(Continued)

*Primary Examiner* — Matthew D. Troutman
(74) *Attorney, Agent, or Firm* — Leydig, Voit & Mayer, Ltd.

(57) ABSTRACT

A wear member for attachment to a surface of a machine is provided, the wear member a body having an outer layer and a base layer. The outer layer including a plurality of channels formed in an outer surface. The base layer is attached to an inner surface of the outer layer. The base layer is divided into a plurality of base layer pieces, each of the plurality of base layer pieces including at least one interfacing edge. The plurality of base layer pieces are assembled together such that each interfacing edge of each of the plurality of base layer pieces is opposite an interfacing edge of another of the plurality of base layer pieces so as to define at least one gap therebetween.

8 Claims, 12 Drawing Sheets

(56) References Cited

U.S. PATENT DOCUMENTS

| | | | | |
|---|---|---|---|---|
| 9,428,866 | B2 * | 8/2016 | Sulesky | E01B 27/025 |
| 2008/0072514 | A1 | 3/2008 | Barlow | |
| 2015/0110592 | A1 | 4/2015 | Voelz et al. | |
| 2015/0191899 | A1 | 7/2015 | Jones | |

FOREIGN PATENT DOCUMENTS

| | | | | |
|---|---|---|---|---|
| JP | 5336865 | B2 | 7/2010 | |
| WO | WO 9115637 | A1 * | 10/1991 | E02F 3/401 |
| WO | 9732090 | | 9/1997 | |
| WO | WO 2015/017894 | A1 | 2/2015 | |

* cited by examiner

WEAR MEMBER

TECHNICAL FIELD

This disclosure relates generally to machines with ground engaging components and, more particularly, to wear members that can be used with such ground engaging components.

BACKGROUND

Many machines used in the construction, mining, forestry and agriculture industries, such as tractors, bulldozers, backhoes, excavators, motor graders and trucks, have components that frequently come into contact with the ground during work operations. For example, many of these machines may include a work implement that can be used by the machine to perform a variety of tasks including, for example, loading compacting and lifting. In the course of performing these tasks, the work implement may come into contact with the ground. For example, a machine may use a blade or bucket to move and level earth or materials being excavated or loaded. The earth-working blades and buckets frequently experience extreme wear from repeated contact with highly abrasive materials encountered during operation. The replacement of these work implements can be costly and labor intensive.

Wear members may be used to help protect the work implements and other ground engaging components of a machine from excessive wear. Typically, a wear member is a removable component that can be attached to the areas of the work implement or machine that encounter the most damaging and repeated abrasions and impacts. When attached, the wear members help absorb the abrasions and impacts and thereby protect the work implement. When the wear member itself becomes worn through use, it can be removed and replaced with new wear member at a reasonable cost to permit the continued use of the wear member. By protecting the implement with one or more wear members and replacing the worn wear members at appropriate intervals, significant cost and time savings are possible.

Some wear members have issues that can limit their versatility. In particular, it can be useful if a wear member is designed so as to maximize its versatility such that it can be attached to a variety of different surfaces on a machine. Two factors that may influence the versatility of a wear member include the sizes and/or configurations that the wear member may take and the ability of the wear member to conform to curved surfaces. For example, it may be desirable that a wear member can be manufactured in a variety of different sizes so that it may better match up with the size of the surface which the wear member is to protect. Additionally, it can be helpful if a wear member can be bent or curved so to be able to be attached to a bent or curved surface.

A wear member that can be used on machines is disclosed in U.S. Pat. No. 8,795,828 ("the '828 patent"). The wear member disclosed in the '828 patent includes a wear surface and a mounting surface with the wear surface consisting of a metal alloy with preformed ceramic shapes embedded therein. The wear surface has a plurality of channels formed therein while the mounting surface also has a plurality channels formed therein with each channel on the mounting surface extending parallel to a channel in the wear surface. The channels in the wear surface and the mounting surface extending in a lateral direction across the width of the wear member between the longest sides of the wear member. As a result of this configuration, there may be limitations with regard to how large the wear member of the '828 patent can be made as well as problems with the mounting surface cracking or breaking when the wear member is attached to a curved surface.

SUMMARY

In one aspect, the disclosure describes a wear member for attachment to a surface of a machine. The wear member includes a body having a pair of opposing first sides and a pair of opposing second sides. An outer layer of the body has an outer surface and an inner surface. The outer layer includes a plurality of channels formed in the outer surface, the channels being parallel to each other and extending between the first sides of the body. A base layer of the body is attached to the inner surface of the outer layer and adapted for attachment to the surface of the machine. The base layer is divided into a plurality of base layer pieces, each of the plurality of base layer pieces including at least one interfacing edge. The plurality of base layer pieces are assembled together such that each interfacing edge of each of the plurality of base layer pieces is opposite an interfacing edge of another of the plurality of base layer pieces so as to define at least one gap therebetween. The interfacing edges of each of the plurality of base layer pieces are configured with at least one finger and at least one recess. The finger and the recess on the interfacing edge of each of the plurality of base layer pieces are configured such that when the base layer pieces are assembled together, the finger on the interfacing edge of each base layer piece is received in the recess in the interfacing edge of another of the base layer pieces that is complementarily configured and such that the at least one gap between the plurality of pieces does not extend parallel to a full length of any of the channels in the outer surface between the first sides of the body.

In another aspect, the disclosure describes a wear member for attachment to a surface of a machine. The wear member includes a body having a pair of opposing first sides and a pair of opposing second sides. An outer layer of the body has an outer surface and an inner surface, the outer layer including a plurality of channels formed in the outer surface. The channels are parallel to each other and extend between the first sides of the body. A base layer of the body is attached to the inner surface of the outer layer and adapted for attachment to the surface of the machine. The base layer is divided into a plurality of pieces, each of the plurality of pieces including at least one interfacing edge. The plurality of pieces are assembled together such that each interfacing edge of each of the plurality of pieces is opposite an interfacing edge of another of the plurality of pieces so as to define at least one gap therebetween. The interfacing edges of each of the plurality of pieces are configured such that the at least one gap between the plurality of pieces does not extend parallel to a full length of any of the channels in the outer surface between the first sides of the body.

In yet another aspect, the disclosure describes a wear member for attachment to a surface of a machine. The wear member includes a body having a pair of opposing first sides and a pair of opposing second sides. An outer layer of the body has an outer surface and an inner surface. The outer layer includes a plurality of channels formed in the outer surface, the channels being parallel to each other and extending between the first sides of the body. A base layer of the body is attached to the inner surface of the outer layer and adapted for attachment to the surface of the machine. The base layer is divided into a first end piece, a second end piece and a center piece. Each of the first and second end pieces includes one interfacing edge and the center piece includes first and second interfacing edges. The first and second end pieces and the center piece are assembled together such that the interfacing edge of the first end piece is opposite the first interfacing edge of the center piece so as to define a first gap therebetween and the interfacing edge of the second end piece is opposite the second interfacing edge of the center piece so as to define a second gap therebetween. The interfacing edges of each of the first and second end pieces and the first and second interfacing edges of the center pieces are configured with at least one finger and at least one recess. The finger and the recess are configured such that when the base layer pieces are assembled together, the finger on the interfacing edge of the first end piece is received in the recess in the first interfacing edge of the center piece which is complementarily configured and the finger on the first interfacing edge of the center piece is received in the recess in the interfacing edge of the first end piece which is complementarily configured and the finger on the interfacing edge of the second end piece is received in the recess in the second interfacing edge of the center piece which is complementarily configured and the finger on the second interfacing edge of the center piece is received in the recess in the interfacing edge of the second end piece which is complementarily configured.

DETAILED DESCRIPTION

Figure 1:
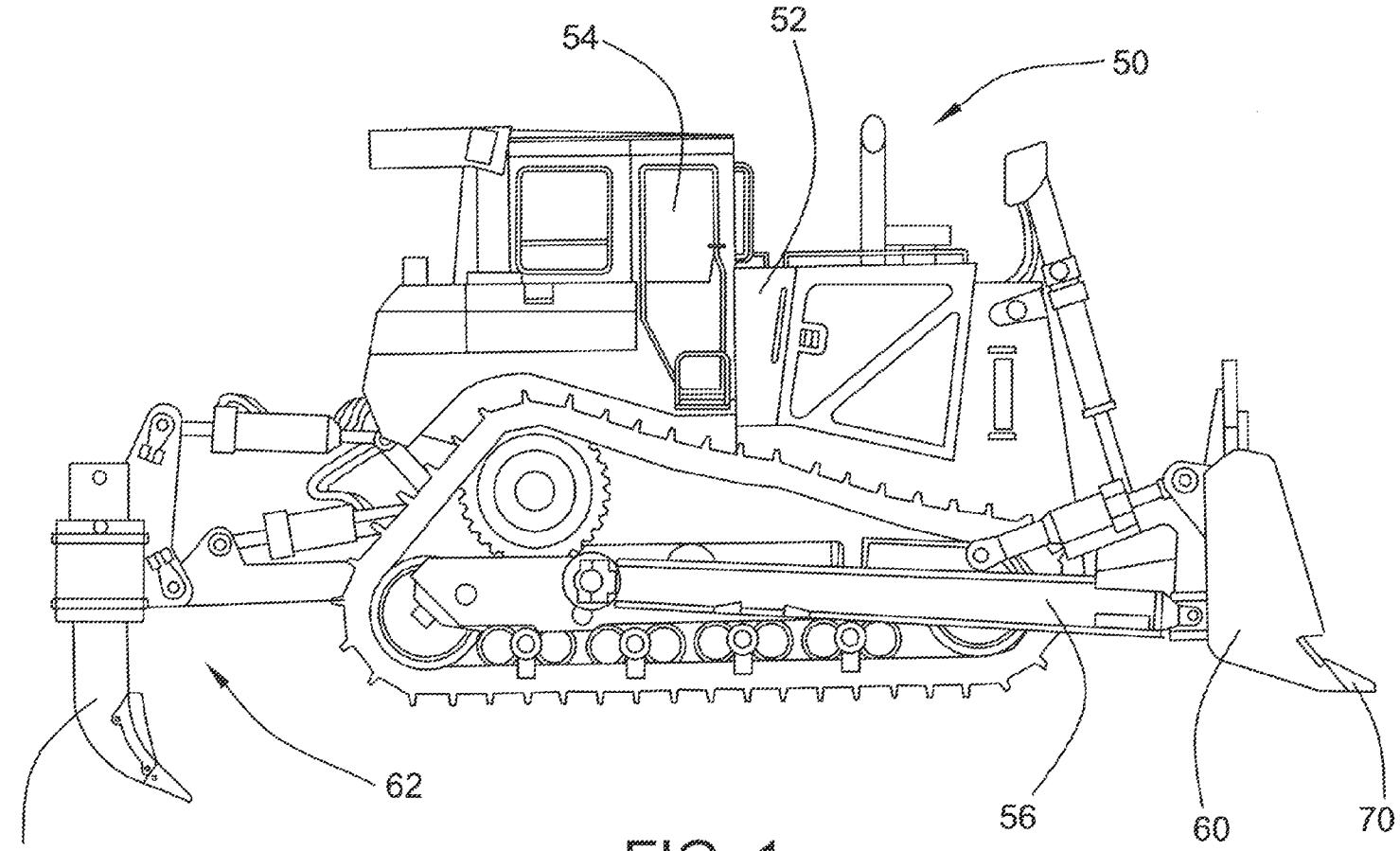
FIG. 1 is a diagrammatic side view of an exemplary machine including an earth-working implement having at least one wear member according to the present disclosure.

This disclosure generally relates to wear members that can be attached to machines to improve the wear resistance of components, for example to the ground engaging implements, of the machines that may be subject to abrasion and repeated impacts. With reference to FIG. 1 of the drawings, an exemplary machine 50 in the form of a track-type tractor is showing that can include an embodiment of an implement wear member 100 constructed in accordance with principles of the present disclosure. Among other uses, a track-type tractor can be used to move and strip working material in various surface mining or construction applications.

As shown in FIG. 1, the machine 50 can include a body 52 with a cab 54 to house a machine operator. The machine 50 can also include an arm system 56 pivotally connected at one end to the body 52 or undercarriage and supporting an earth-working implement assembly 60 at an opposing, distal end. In certain embodiments, the implement assembly 60 can include any suitable implement, such as an earth-working blade, or any other type of suitable device. The illustrated machine 50 also includes a ripper assembly 62 having a ripper 64 opposite the implement assembly 60. The ripper 64 can be used to cut through and break up working material for removal. A control system can be housed in the cab 54 that can be adapted to allow a machine operator to manipulate and articulate the implement assembly 60 and/or the ripper assembly 62 for digging, excavating, or any other suitable application.

Figure 2:
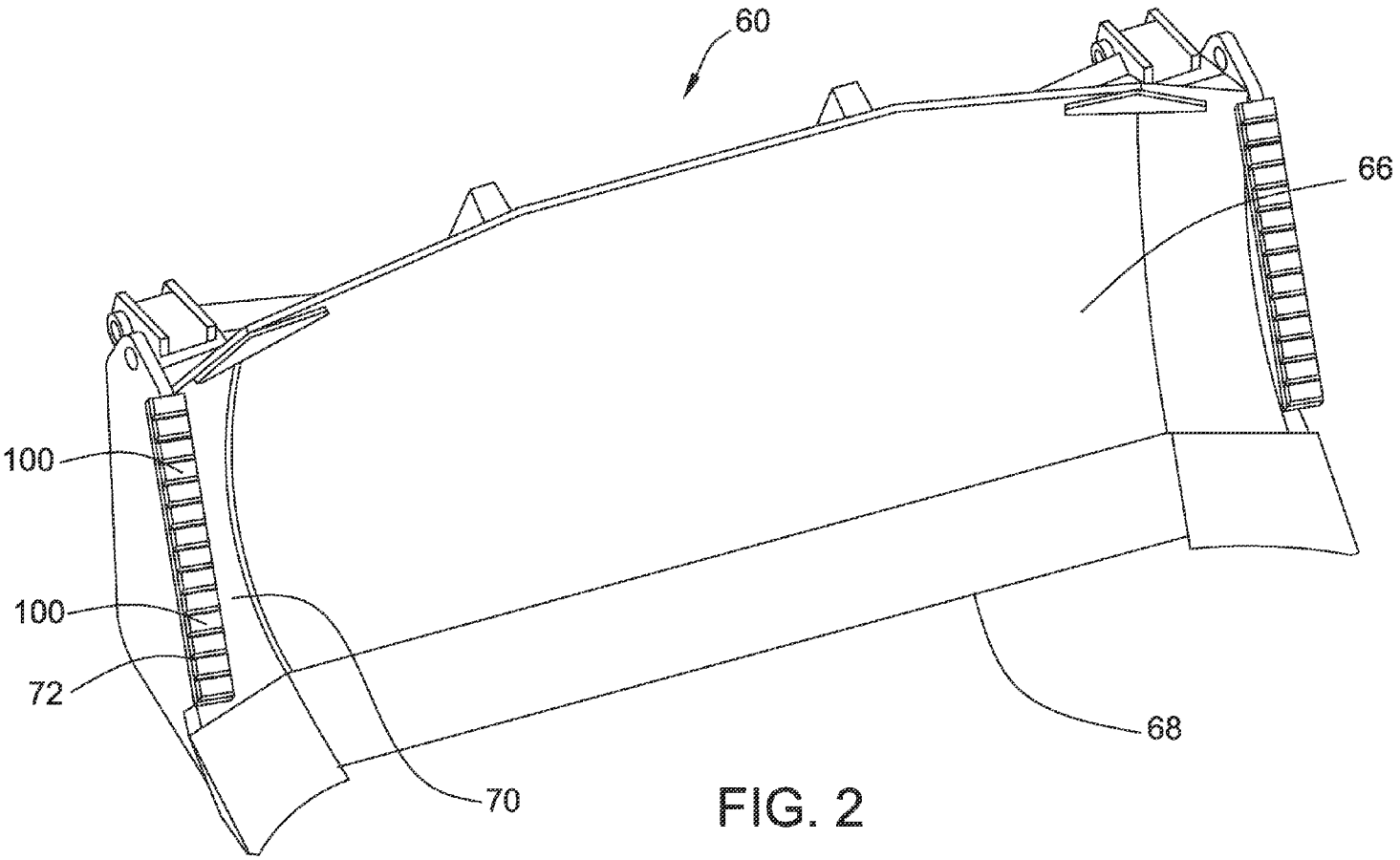
FIG. 2 is a front view of the earth-working implement of FIG. 1 showing the attached wear members according to the present disclosure.

FIG. 2 shows an embodiment of the implement assembly 60. Referring to FIG. 2, the implement assembly 60 can include an earth-working blade 66 that is adapted to engage the ground or other excavation or work surface. The illustrated blade includes a lower edge 68 and opposing side edges 72 that are provided on opposing side walls 70 of the blade 66. In this case, each of the side edges 72 of the blade 66 has one or more wear members 100 attached thereto. As discussed further below, the wear members 100 may be attached to the side edges 72 by any suitable means, such as welding, in order to protect that surface against abrasion and/or impacts. Over time, the wear members 100 can be subjected to wear and eventually can be replaced to allow the further use of the implement assembly 60.

While FIG. 2 shows the wear members 100 attached to the side edges 72 of the blade 66, it should be understood that this is just one example of an installation location for the wear members 100. Wear members 100 could also be provided on other surfaces of the blade 66 and the implement assembly 60. Moreover, although FIGS. 1 and 2 illustrate the use of certain embodiments of wear members constructed in accordance with principles of the present disclosure with the blade of a track-type tractor, many other types of implements and mining, earth-working, agricultural, construction and other types of machinery can benefit from using wear members as described herein. It should be understood that, in other embodiments, wear members constructed in accordance with principles of the present disclosure can be used in a variety of other implements and/or machines including, for example, various types of mining, earth-working, agricultural and construction machinery.

Figure 3:
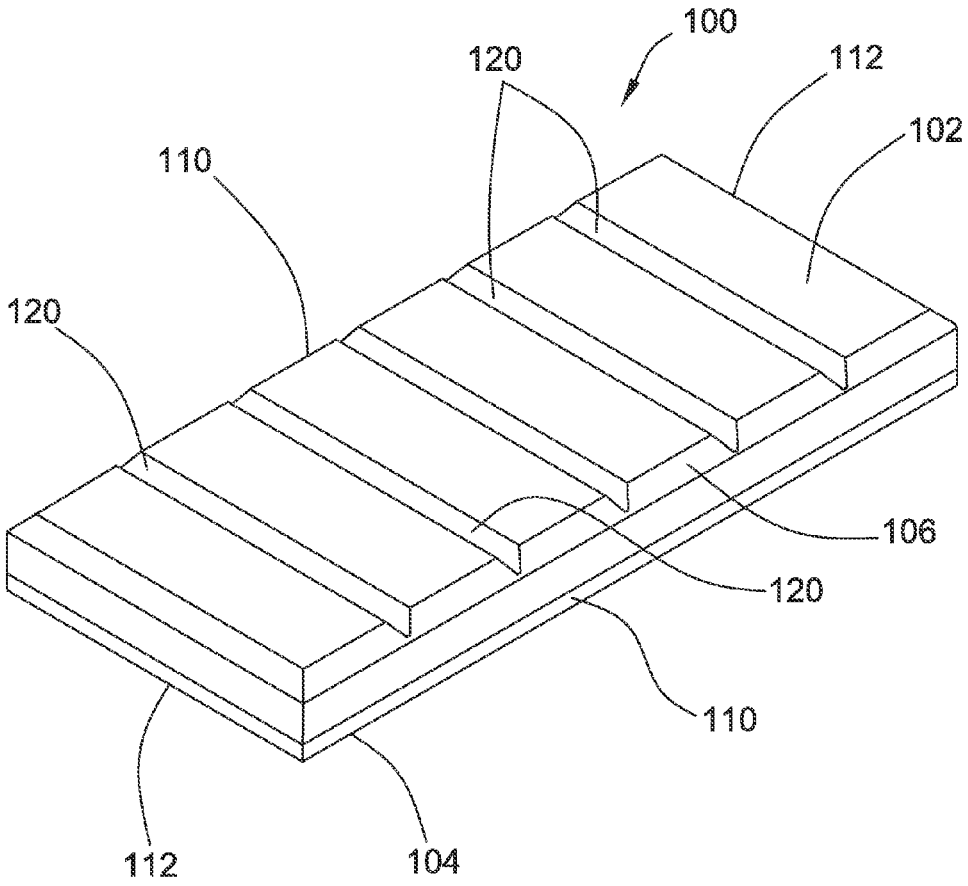
FIG. 3 is a perspective view of one embodiment of a wear member according to the present disclosure.
Figure 4:
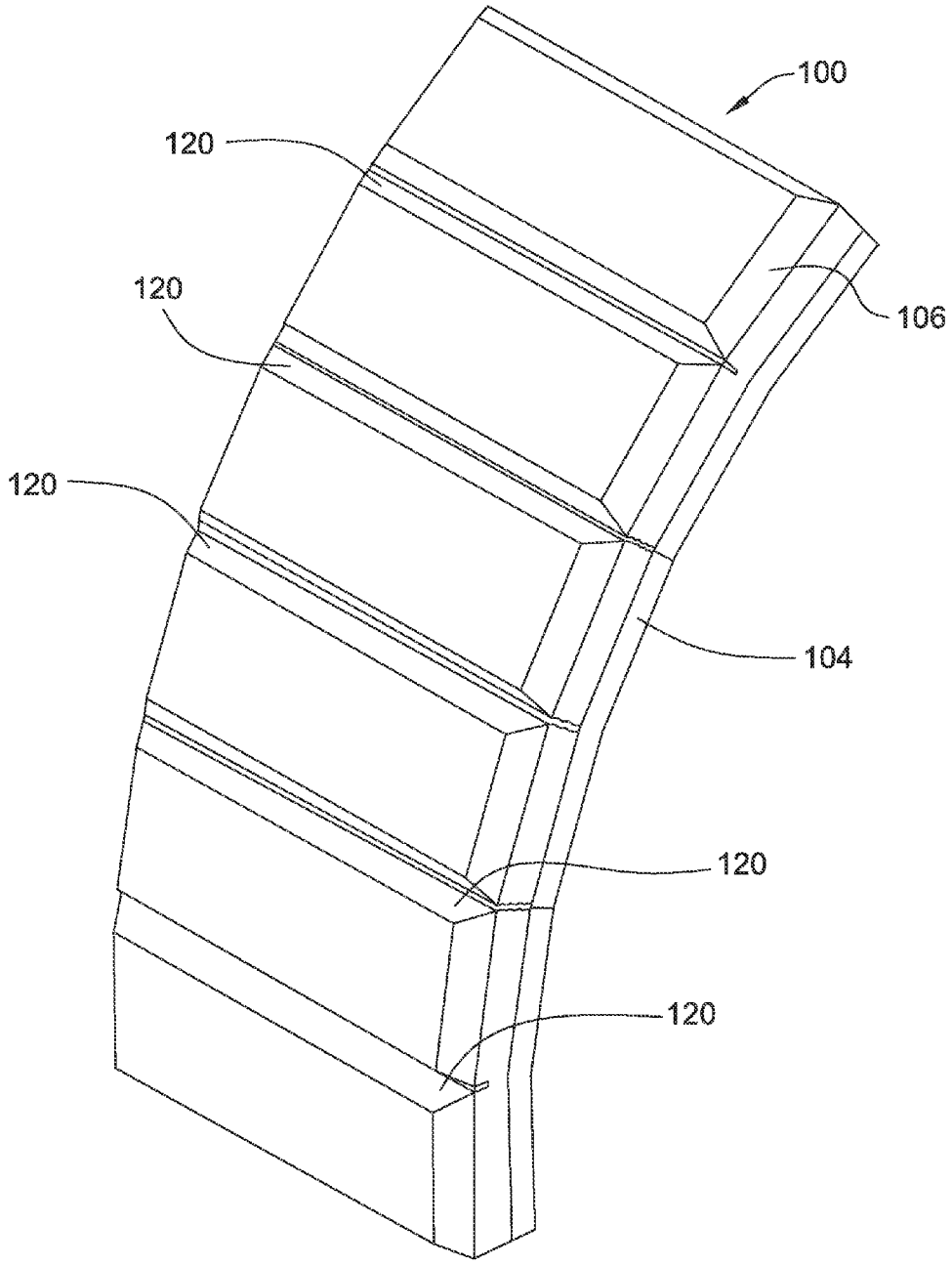
FIG. 4 is a perspective view of the wear member of FIG. 3 in a bent configuration and with the outer layer fractured.
Figure 7:
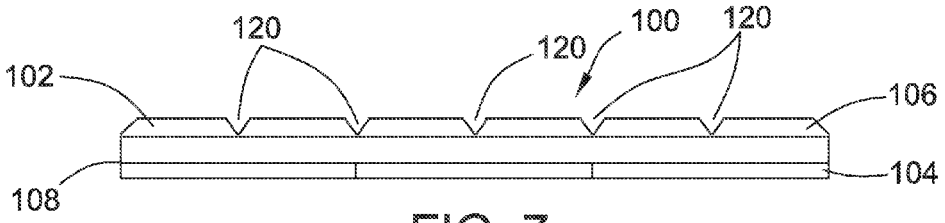
FIG. 7 is a side view of the wear member of FIG. 3.
Figure 5:
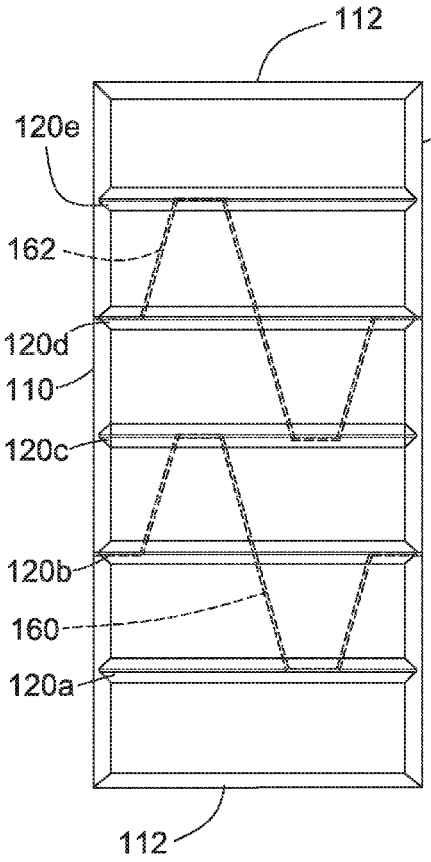
FIG. 5 is a top view of the wear member of FIG. 3.

Referring now to FIGS. 3-7, various views of an exemplary embodiment of the wear member 100 are provided. As shown in FIGS. 3 and 4, the wear member 100 may include a body 102 having a base layer 104 that is adapted for attachment to a surface to be protected and an outer layer 106 the outer surface 105 of which is exposed and faces away from the surface being protected by the wear member 100. The base layer 104 may be connected to an inner surface 107 of the outer layer 106 by any suitable method. One method that may be used is brazing, with a brazing material 108 (see FIG. 7) being provided between the outer layer 106 and the base layer 104. In the illustrated embodiment, the wear member 100 has a substantially rectangular configuration, although it should be appreciated that the wear member 100 could have a shape different than that shown in the drawings. As shown in FIGS. 3-6, the body 102 of the wear member 100 may have a pair of opposing first longitudinal sides 110 that in this case extend parallel to each other. The body 102 may also have a pair of opposing second lateral sides 112 that in this case also extend parallel to each other. Because of the rectangular configuration of the wear member 100, the first longitudinal sides 110 are relatively longer than the second lateral sides 112, although as noted above the sides could have different relative lengths, including substantially equal lengths, if the wear member 100 has a different shape.

Because it is exposed to abrasions and/or impacts, the outer layer 106 of the wear member 100 may be made of a relatively hard, abrasion resistant material. One example of a suitable material for the outer layer 106 is cast white iron. However, the outer layer 106 is not limited to this material. Examples of other materials that could be used for the outer layer 106 include ceramics, metal-ceramic composite materials, abrasion resistant steel alloys, metal alloys including embedded tungsten. Ranges of what may be considered relatively hard may vary depending on the application in which the wear member is to be used, but in one example relatively hard materials are those having Vickers hardness of at least about HV=1300.

In order to help the wear member 100 conform to non-flat shapes, the outer layer 106 of the wear member 100 may have a plurality of channels 120 in the outer surface thereof. These channels 120 may facilitate fracture of the outer layer 106 at certain preselected locations, i.e. the locations of the channels 120, when the wear member 100 is being fit onto a non-flat surface (see, e.g., FIG. 4 in which the three channels 120 in the center of the wear member 100 are fractured). In this case, the channels 120 may extend parallel to each other between the first longitudinal sides 110 of the wear member 100. The channels 120 may be spaced equidistance from each other. Moreover, the channels 120 may extend inward from the outer surface 105 of the outer layer 106 a distance less than entire thickness of the outer layer 106. Thus, in one embodiment, the channels 120 in the outer layer 106 should not extend through the entire thickness of the outer layer 106. The number, spacing and depth of the channels 120 in the outer layer 106 is not limited to what is shown in FIGS. 3-7 and may vary depending on the configuration of wear member 100 and/or the application in which it is to be used. For example, relatively more or relatively fewer channels 120 may be provided depending on the size of the wear member 100. In addition, the channels 120 may be spaced relatively closer together (with more total channels) or farther apart (with less total channels) if more or less potential fracture locations are desired on a wear member 100 of a given size.

As noted above, the base layer 104 may be configured for attachment to a surface of a machine. According to one embodiment, this may be accomplished by constructing the base layer 104 of a material that can be welded to metal surface. One example of a suitable weldable material for use as the base layer 104 is a mild steel alloy, such as a steel having a carbon content of approximately 0.05% to approximately 0.15%. Of course, the base layer 104 also could be made of other materials that would permit welding of the base layer 104 to a surface of a machine.

The base layer 104 may be divided into a plurality of base layer pieces with the plurality of pieces being assembled together so as to define gaps in the base layer 104 between the pieces. More specifically, each of the plurality of pieces of the base layer may configured such that none of the gaps between the pieces extend parallel to the full length of any one of the channels 120 in the outer layer 106 of the wear member 100. In other words, with respect to the illustrated embodiment, the plurality of base layer pieces may be configured such that none of the gaps between the pieces extend all of the way between the first longitudinal sides 110 of the wear member 100 parallel to one of the channels 120 in the outer layer 106. Further, the plurality of base layer pieces may be configured such that if any section of the gaps between the plurality of pieces does extend parallel to one of the channels 120 in the outer layer 106, it does so for less than the full length of the respective channel 120.

Figure 6:
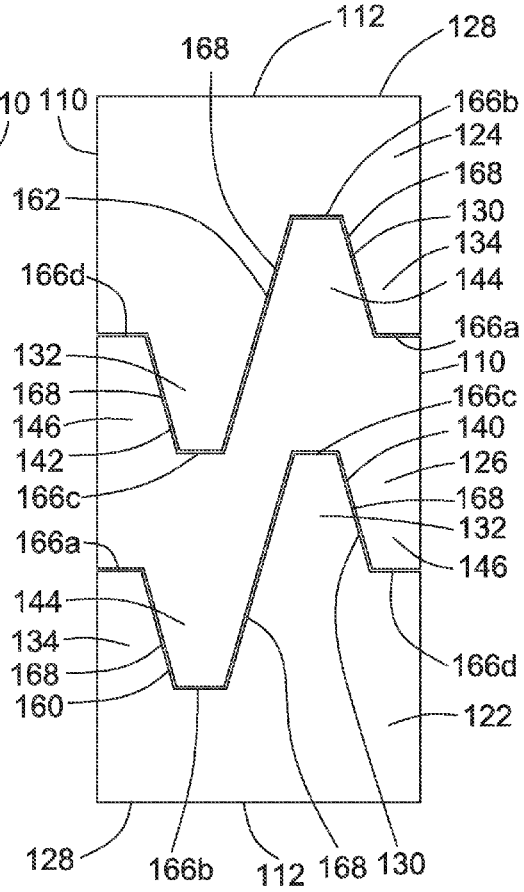
FIG. 6 is a bottom view of the wear member of FIG. 3
Figure 8:
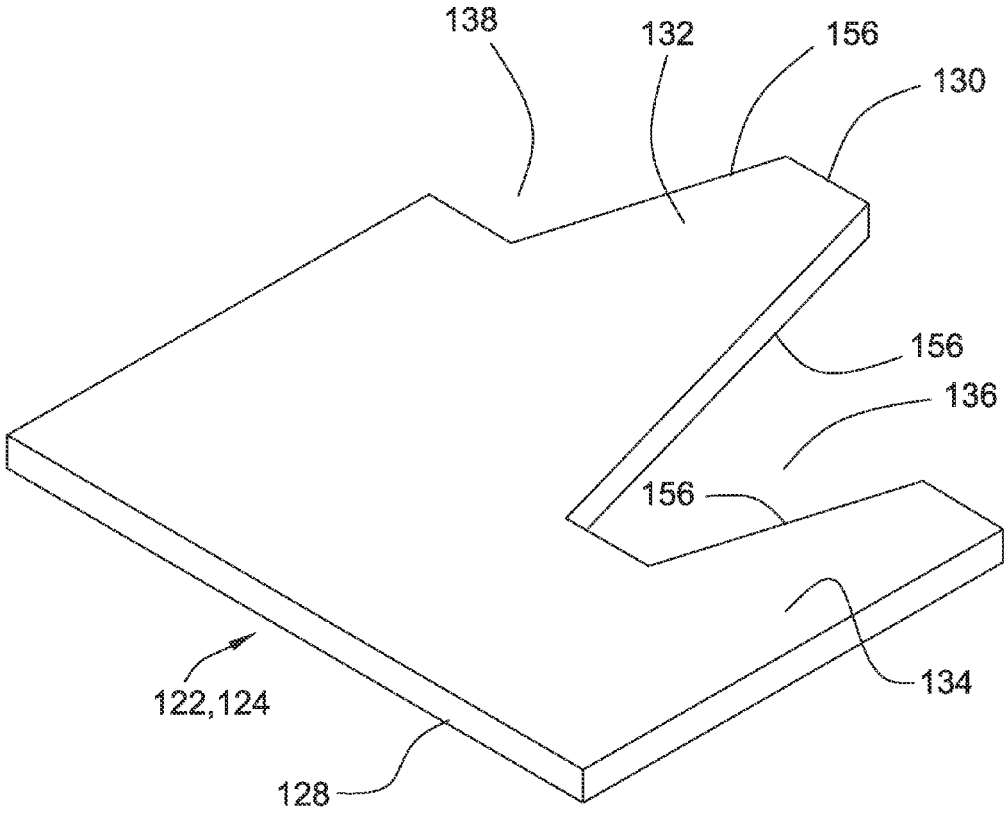
FIG. 8 is a perspective view of an end piece of the base layer of the wear member of FIG. 3.

One embodiment of a multi-piece base layer 104 according to present disclosure is shown in FIG. 6. The base layer 104 of FIG. 6 is divided into three pieces including first and second end pieces 122, 124 (one of which is shown individually in FIG. 8) and a center piece 126 (shown individually in FIG. 9). The first and second end pieces 122, 124 of the base layer 104 may each include a first edge 128 that in this case coincides with one of the second lateral sides 112 of wear member 100 and an opposing second interfacing edge 130 that is configured with at least one finger 132 that extends outward in a first direction away from the first edge 128 and at least one recess 136 that extends inward in a direction opposite the first direction towards the first edge 128. In the illustrated embodiment, the interfacing edge 130 of each of the first and second end pieces 122, 124 includes a first finger 132 and a second finger 134 both of which extend in a longitudinal direction of the wear member 100 when the plurality of pieces 122, 124, 126 are assembled together as shown in FIG. 6. The interfacing edge 130 of each of the illustrated first and second end pieces 122, 124 also includes first and second recesses 136, 138. It should be understood that the interfacing edges 130 of the end pieces 122, 124 may have different numbers of fingers and recesses depending, for example, on the size of the wear member 100.

Figure 9:
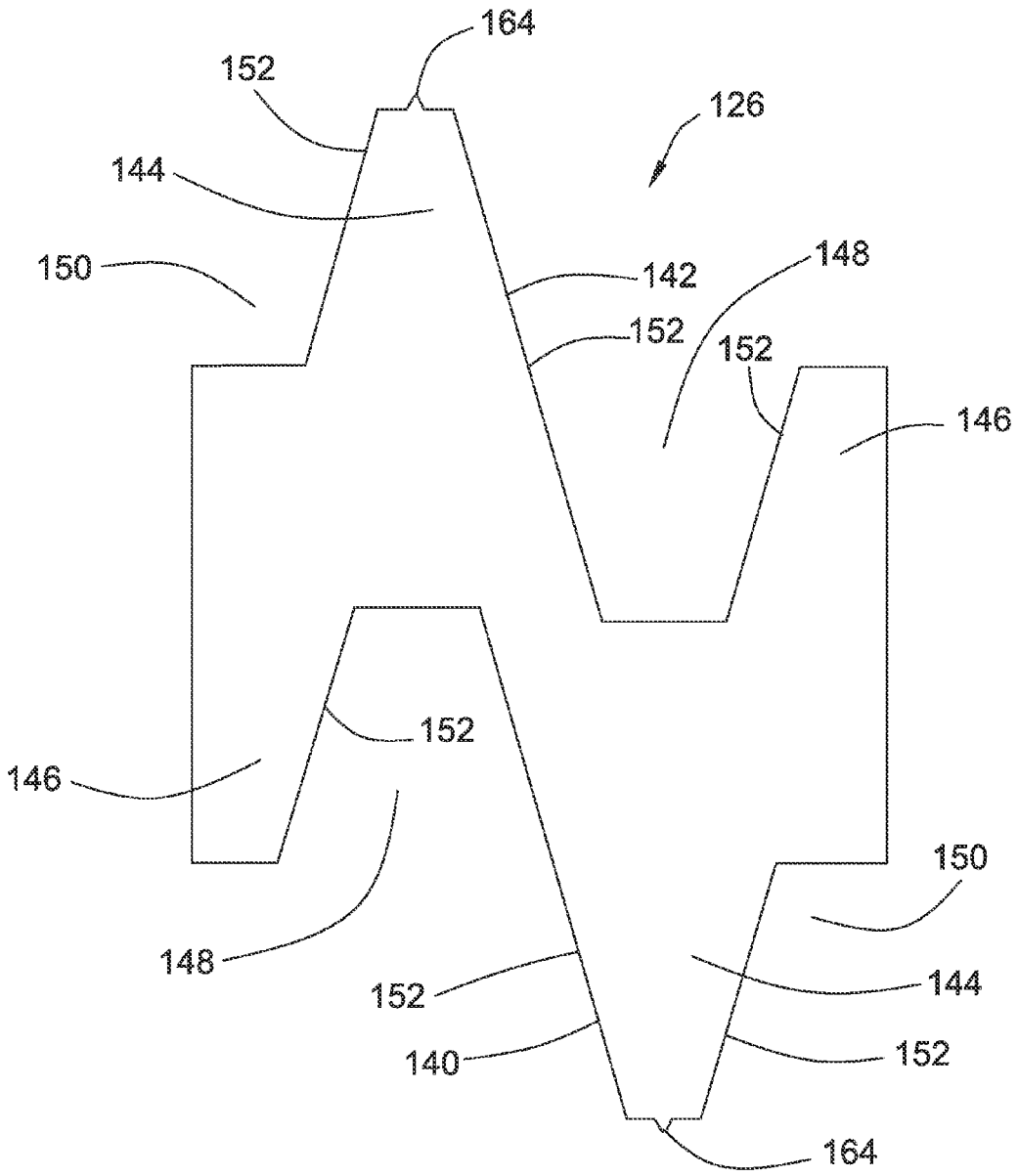
FIG. 9 is a plan view of a center piece of the base layer of the wear member of FIG. 3.
Figure 10:
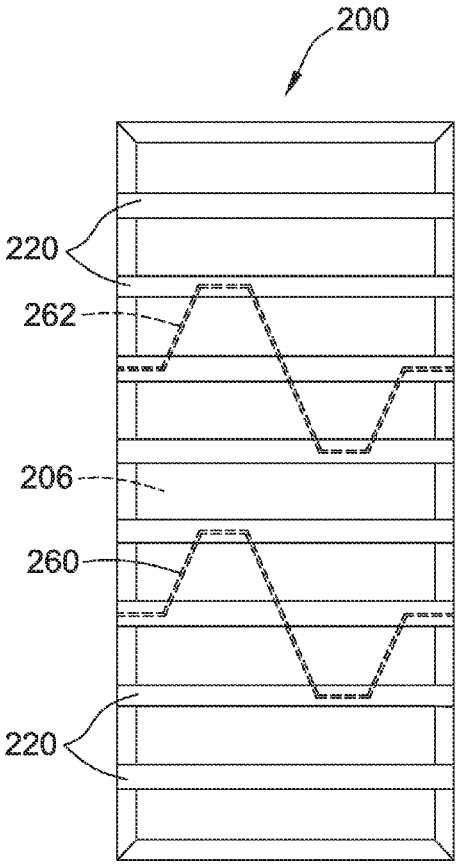
FIG. 10 is a top view of a further embodiment of a wear member according to the present disclosure.
Figure 11:
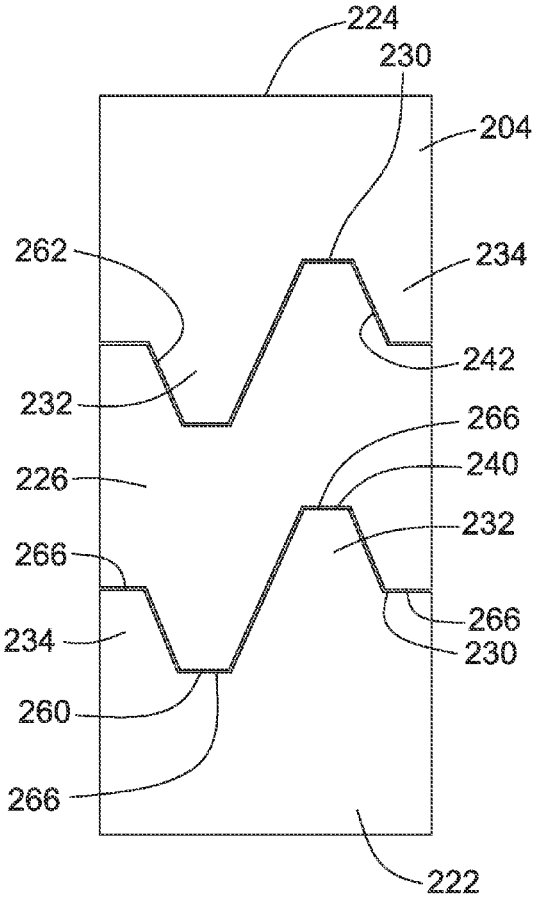
FIG. 11 is a bottom view of the wear member of FIG. 10 according to the present disclosure.
Figure 12:
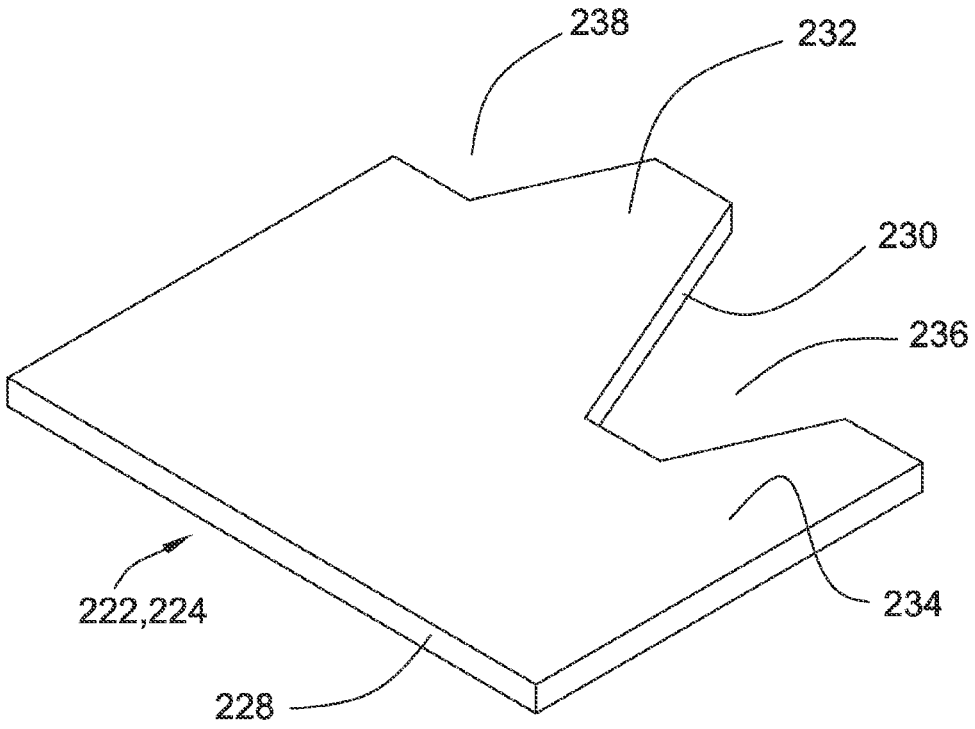
FIG. 12 is a perspective view of an end section of the base layer of the wear member of FIG. 10.
Figure 13:
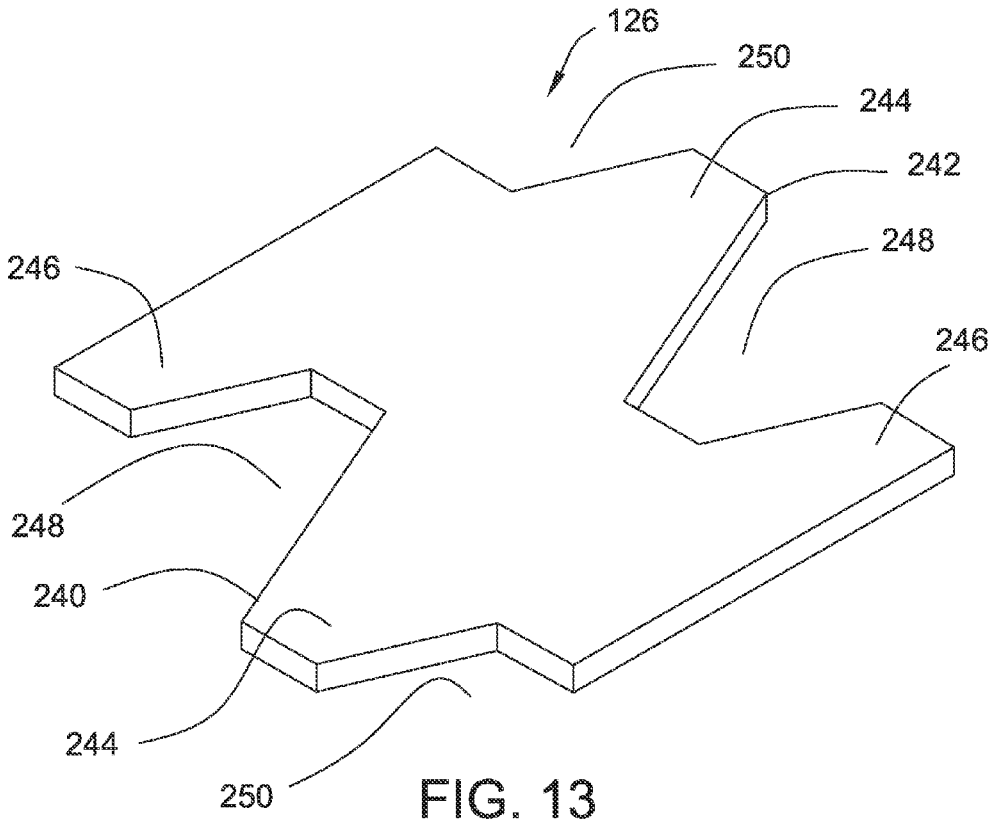
FIG. 13 is a perspective view of a center section of the base layer of the wear member of FIG. 10.

As best shown in FIG. 9, the center piece 126 may be configured with opposing first and second interfacing edges 140, 142 each of which is configured with at least one finger 144 that extends outward in a first direction away from the opposing interfacing edge and at least one recess 148 that extends inward in a direction opposite the first direction towards the opposing interfacing edge. Like the first and second end pieces 122, 124, in the illustrated embodiment, each of the first and second interfacing edges 140, 142 of the center piece 126 includes a first finger 144 and a second finger 146 both of which extend in a longitudinal direction of the wear member 100 when the plurality of pieces are assembled together as shown in FIG. 6. Likewise, each of the first and second interfacing edges 140, 142 of the illustrated center piece 126 also include first and second recesses 148, 150. Again, as with the end pieces, the first and second interfacing edges 140, 142 of the center piece 126 may have different numbers of fingers and recesses depending, for example, on the size of the wear member 100.

The recesses 136, 138 and fingers 132, 134 on the interfacing edges 130 of the first and second end pieces 122, 124 of the base layer 104 and the recesses 148, 150 and fingers 144, 146 on the first and second interfacing edges 140, 142 of the center piece 126 may be configured complementarily. More particularly, when assembled together to form the base layer 104, each finger 132, 134 on the first and second end pieces 122, 124 may be received in a complementarily configured recess 148, 150 on a respective one of the interfacing edges 140, 142 of the center piece 126 and each finger 144, 146 on each of the first and second interfacing edges 140, 142 of the center piece 126 may be received in a complementarily shaped recess 136, 138 in the interfacing edge 130 of a respective one of the first and second end pieces 122, 124. Thus, when assembled together to form the base layer 104, the first and second end pieces 122, 124 and center piece 126 may have an interlocking relationship with overlapping fingers.

The sides of the projecting fingers and recesses on the interfacing edges of the first and second end pieces and the center pieces may be angled. More particularly, the sides 152 of the fingers 144, 146 and recesses 148, 150 on the center piece 126 may be angled such that the fingers narrow and the recesses expand as they extend away from the centerline of the center piece. Additionally, the sides 156 of the fingers 132, 134 and recesses 136, 138 on the first and second pieces 122, 124 may be angled such that the fingers narrow and the recesses expand as they extend in the direction away from the first edge 128 of the respective end piece. This angled configuration can facilitate nesting of the first and second end pieces 122, 124 with the center piece 126 when the base layer 104 is formed and thereby simplify the assembly process. It should be appreciated that the configuration of the sides of the fingers and recesses may be different than that shown in the drawings. For example, the sides of the fingers and recesses may be at a different angles or extend parallel to each other.

When assembled together to form the base layer 104, the first and second end pieces 122, 124 and the center piece 126 may be arranged such that gaps are formed between the interfacing edges of the pieces. Specifically, a first gap 160 may be defined between the interfacing edge 130 of the first end piece 122 and the first interfacing edge 140 of the center piece 126. Similarly, a second gap 162 may be defined between the interfacing edge 130 of the second end piece 124 and the second interfacing edge 142 of the center piece 126. The formation of these first and second gaps 160, 162 may be facilitated by a spacer projection 164 that may be provided on the end of at least one of the projecting first and second fingers 144, 146 on each of the first and second interfacing edges 140, 142 of the center piece 126 as shown in FIG. 9. When forming the base layer 104, these spacer projections 164 may abut against the interfacing edge 130 of a respective one of the first and second end pieces 122, 124 to ensure that a gap is provided between the interfacing edges. In this way, the width of the first and second gaps 160, 162 may be defined, at least in part, by the length of the spacer projection 164.

The interfacing edges 130, 140, 142 of the first and second end pieces 122, 124 and the center piece 1126 may be configured such that each of first and second gaps 160, 162 forms a zig-zag pattern that extends between the longitudinal sides 110 of the wear member 100. Further, the first and second end pieces 122, 124 and the center piece 126 may be configured such that each of the first and second gaps 160, 162 may include at least one first gap section 166 that extends parallel to a portion of one of the channels 120 in the outer layer 106 of the wear member 100. The relative position of these gap sections to the channels 120 in the outer layer 106 of the wear member 100 are best shown in the top view of FIG. 5 in which the first and second gaps 160, 162 between the pieces in the base layer 104 are shown in broken lines. In the illustrated embodiment, each of the first and second gaps 160, 162 includes four such first gap sections 166 including one first gap section 166*a* that extends parallel to a section of a respective one of first or fifth channels 120*a*, 120*e* in the outer layer 106 nearest the respective second lateral side 112 of the wear member and two first gap sections 166*b* and 166*c* that both extend parallel to a respective one of a second or fourth channel 120*b*, 120*d* in the outer layer 106 nearer the center of the wear member. Another first gap section 166*d* of each of the first and second gaps 160, 162 extends parallel to, in this case, a center third channel 120*c* in the outer layer 106 of the wear member 100. These first gap sections 166*a-d* of the first and second gaps 160, 162 that extend parallel to one of the channels 120 in the outer layer 106 may be formed by configuring the ends of the fingers 132, 134, 144, 146 and recesses 136, 138, 148, 150 in the interfacing edges 130, 140, 142 of the first and second end pieces 122, 124 and the center piece 126 as linear segments.

Providing first gap sections 166 of the first and second gaps 160, 162 that align parallel with a portion of a channel 120 in the outer layer 106 of the wear member 100 can help ensure that the outer layer 106 fractures in the desired location when the wear member 100 is bent to conform to a surface such as shown in FIG. 4. In FIG. 4, the outer layer 106 of the wear member 100 is fractured at each of the three channels 120*b, c* and *d* in the center of the wear member 104. FIG. 4 illustrates only one example of how the outer layer 106 may fracture when the wear member 100 is curved and in other circumstances the wear member may fracture at one or more different channels. Where the outer layer 106 fractures is further controlled by configuring these first gap sections 166 of the first and second gaps 160, 162 such that they only extend parallel to the respective channel 120 for less than the full length of the channel. Moreover, to the extent that the first and second gaps 160, 162 include multiple first gap sections 166 that extend parallel to the same channel 120 in the outer layer, these gap sections are spaced apart from each other in the widthwise or lateral direction along the length of the respective channel 120 by portions of the base layer 104 that do not include a first gap section 166 parallel to that channel 120. For example, in the illustrated embodiment, the first gap sections 166*a* and 166*d* of each of the first and second gaps 160, 162 extend parallel to the same channel (either the second channel 120*b* or the fourth channel 120*d*). The these first gap sections 166*a*, 166*d*, however, are separated in the widthwise or lateral direction of the base layer 104 by a finger of the center piece 126 and a finger of the respective first or second end piece 122 or 124 such that the first and second gaps 160, 162 do not extend parallel to respectively, the first and fourth channel 120*a*, 120*d* in these areas. These spans where the first and second gaps 160, 162 do not extend parallel to respectively the first and fourth channel 120*a*, 120*d* provide additional strength that can help prevent the wear member 100 from breaking into multiple pieces when it is applied to a curved surface. In the illustrated embodiment, each of the first gap sections 166*a-d* of the first and second gaps 160, 162 is separated by second gap sections 168*a-c* that do not extend parallel to any channel 120 in the outer layer 106 of the wear member 100. According to one embodiment, each of the first gap sections 166*a-d* of the first and second gaps 160, 162 that extends parallel to a channel 120 in the outer layer 106 has a length that is less than about 25% of the entire length of the channel to which it is parallel.

It should be appreciated that the gaps between the plurality of pieces of the base layer 104 may have configurations other than that shown, for example, in FIG. 6 depending on the size and configuration of the wear member 100 and the location of the channels 120 in the outer layer 106. For example, the base layer 104 may be divided into only two pieces such that only a single gap is defined or the base layer 104 may divided into more than three pieces which may result in more than two gaps. Additionally, the configuration of the gap could be different if more or less fingers and recesses or differently configured fingers or recesses (e.g., fingers and recesses with straight sides) are provided on the interfacing edges of the pieces of the base layer 104.

A further embodiment of a wear member 200 having a multi-piece base layer 204 is shown in FIGS. 10-13. In this embodiment, elements the same as or similar to the embodiment of FIGS. 3-9 are given like reference numbers, but in the 200's. The embodiment of FIGS. 10-13 is similar to the embodiment of FIGS. 3-9 except that the first and second end pieces 222, 224 and center piece 226 of the base layer 204 have somewhat different configurations to account for a different configuration of the channels 220 in the outer layer 206. In particular, the outer layer 206 of the embodiment of FIGS. 10-13 has eight channels 220 that are spaced relatively closer together than the channels 220 of outer layer 206 of the embodiment of FIGS. 3-9. To account for the different spacing of the channels 220, the fingers 232, 234, 244, 246 and recesses 236, 238, 248, 250 on the interfacing edges 230, 240, 242 of the first and second end pieces 222, 224 and the center piece 226 of the base layer 204 have configurations different than in the FIGS. 3-9 embodiment. More specifically, the complementary fingers and recesses are somewhat smaller in the longitudinal direction of the wear member 200. Otherwise, the configuration of the FIGS. 10-13 embodiment is substantially the same with each of the first and second gaps 260, 262 including four first gap sections 266 that extend parallel to a portion of one of the channels 220 in the outer layer 206 and with the sections that extend parallel to the same channel 220 being spaced from each other in the lateral or widthwise direction of the wear member 200.

Figure 14:
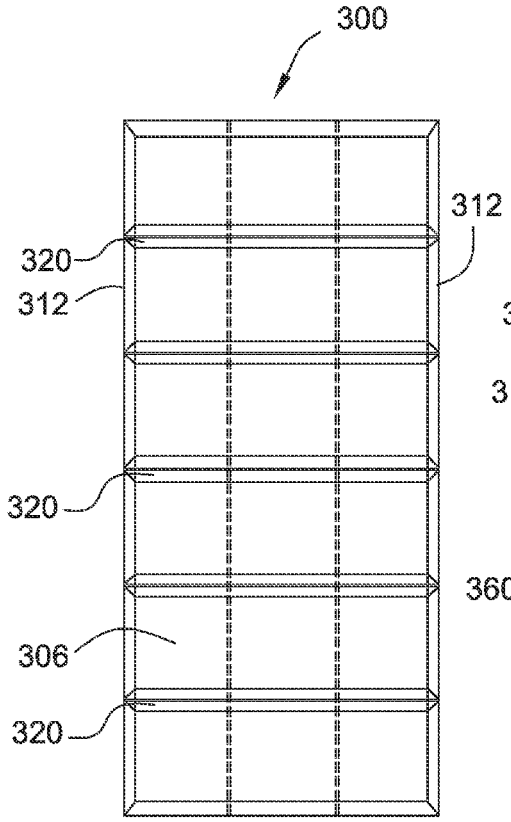
FIG. 14 is a top view of a further embodiment of a wear member according to the present disclosure.
Figure 15:
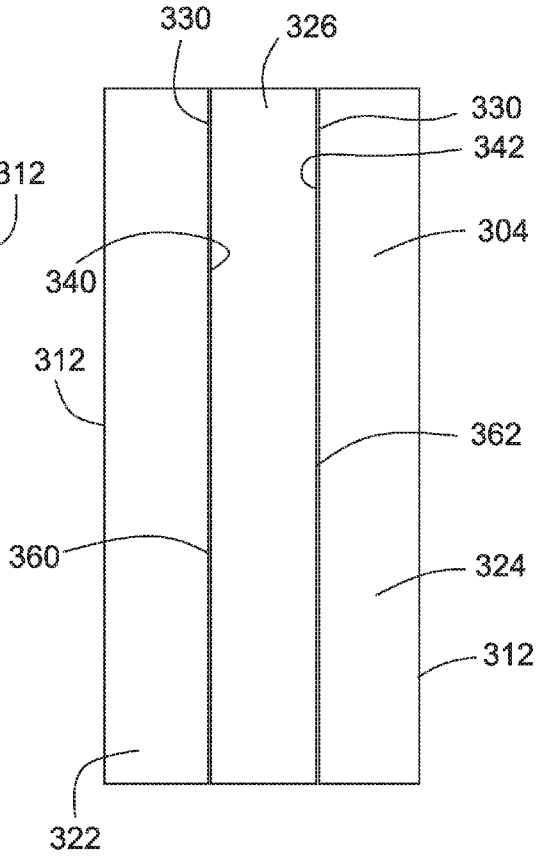
FIG. 15 is a bottom view of the wear member of FIG. 14.

A further embodiment of a wear member 300 having a multi-piece base layer 304 is shown in FIGS. 14 and 15. In this embodiment, elements the same as or similar to the embodiment of FIGS. 3-9 are given like reference numbers, but in the 300's. The embodiment of FIGS. 14 and 15 includes an outer layer 306 having substantially the same configuration as in the FIGS. 3-9 embodiment. However, as opposed to a interlocking finger design, the pieces of the base layer 304 of FIGS. 14 and 15 are configured so as to define first and second gaps 360, 362 that extend in the longitudinal or lengthwise direction of the wear member 300 between the opposing second lateral sides 312. To this end, the base layer 304 may be divided into three substantially rectangular pieces, including two outer pieces 322, 324 and a center piece 326, each of which has a longitudinal length substantially the same as the longitudinal length of the wear member 300 and a lateral width less than the lateral width of the wear member 300. In this case, each of the two outer pieces 322, 324 and center piece 326 of the base layer 304 has substantially the same size although it should be understood the that the three pieces could have different sizes so long as the sum of their widths corresponds to the width of the wear member 300. Additionally, in the illustrated embodiment, the interfacing edges 330 of the two outer pieces 322, 324 and the first and second interfacing edges 340, 342 of the center piece 326 are all substantially straight resulting in first and second gaps 360, 362 that are substantially straight and perpendicular to the channels 320 on the outer layer 306. In other embodiments, however, the interfacing edges 330, 340, 342 could have non-straight configurations including one or more complementary fingers and recesses. Unlike the embodiments of FIGS. 3-9 and 10-13, the first and second gaps 360, 362 in the embodiment of FIGS. 14-15 do not include any sections that extend parallel to a portion of one of the channels 320 in the outer layer 306. However, the pieces of the base layer 304 could be configured with interfacing edges, including for example complementary, straight-sided fingers and recesses, that would provide one or more such sections.

Figure 16:
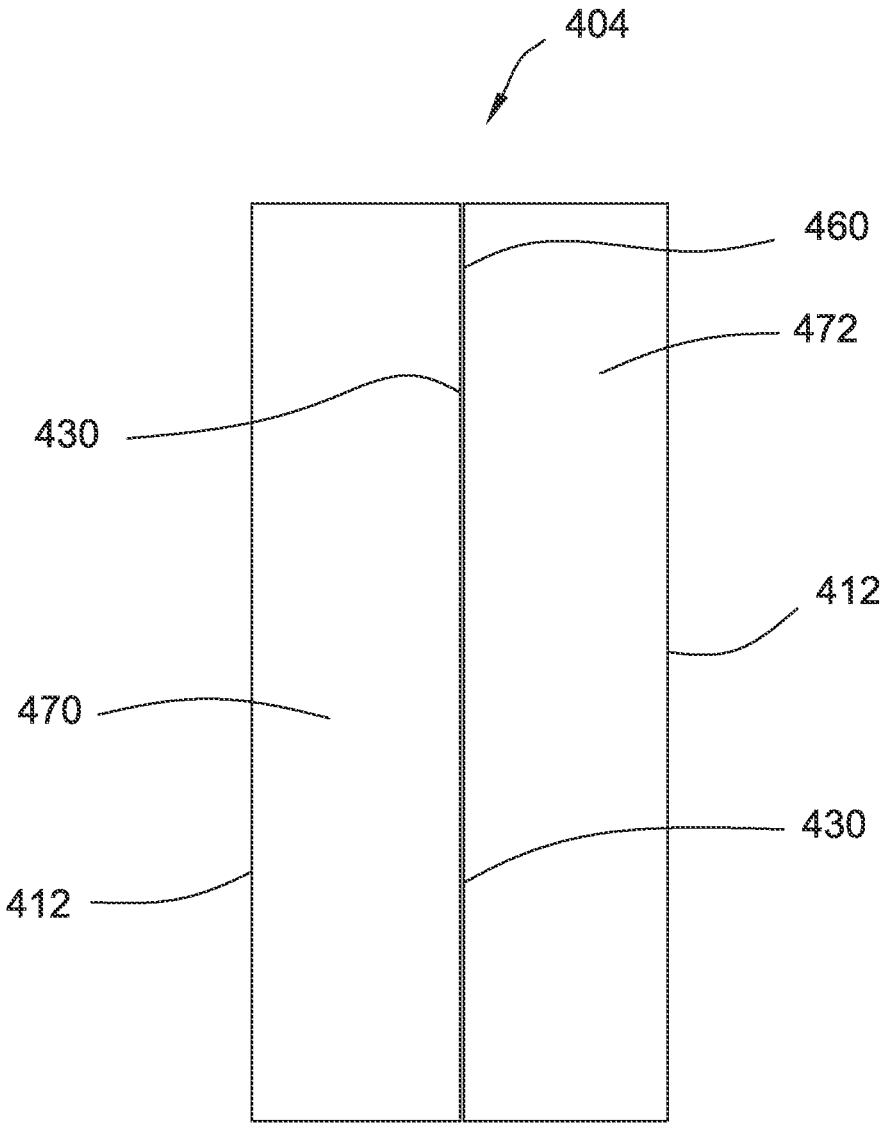
FIG. 16 is a bottom view of the wear member of FIG. 14 showing an alternative embodiment of the base layer.

An alternative embodiment of a base layer 404 that can be used with the outer layer of FIG. 14 is shown in FIG. 16. The base layer 404 of FIG. 16 is similar to the base layer of FIG. 15 except that it is divided into two substantially equal sized rectangular pieces 470, 472 instead of three. Each of the two rectangular pieces 470, 472 presents a substantially straight interfacing edge 430 that produces a single substantially straight gap 460 that extends between the second lateral sides 412 of the wear member in a direction perpendicular to the channels in the outer layer. Again, as discussed above in connection with the base layer of FIG. 14, the interfacing edges 430 of the two pieces 470, 472 could have configurations other than as specifically shown including one or more complementary fingers and recesses. Additionally, the two pieces could also be of different sizes. It also should be appreciated that the base layer could be divided into more than the three pieces shown in FIG. 14.

INDUSTRIAL APPLICABILITY

The wear member of the present disclosure is applicable to any type of surface that may be subject to wear and, in particular, to surfaces of machines that frequently come into contact with the ground or other work material. For example, the present disclosure can be applicable to any machine utilizing an earth-working implement for digging, scraping, leveling, excavating or any other suitable application involving engaging the ground or other work material. The present disclosure, therefore, can be applicable to many different machines and environments. One exemplary use of the wear members of this disclosure can be in mining applications in which machine implements can be commonly used to cut, scrape, dig, or clear various work materials including rock, gravel, sand, dirt, and others for protracted time periods and with little downtime.

The wear members of the present disclosure may have one or more features that may provide for more versatile use. For example, the gaps that are provided between the multiple pieces of the base layer can increase the heat transfer to the brazing material between the base layer and the outer layer during the brazing process. During brazing, difficulties heating the brazing material sufficiently, particularly in center portions of the wear member, can introduce limitations in the size of the wear member. The gaps can allow additional heat to reach the brazing material, including in the center of the wear member, so as to allow the wear members to have relatively larger sizes while maintaining good adhesion between the base layer and outer layer.

The gaps between the multiple pieces of the base layer can also help prevent curling of the wear members caused by different rates of expansion and contraction of the different materials used in the base layer and the outer layer. Dividing the base layer into multiple pieces can allow the pieces to move relative each other and thereby reduce some of the stresses that otherwise may cause the entire wear member to curl. The interfacing edges of the pieces of the base layer through placement of sections that extend parallel to portions of the channels in the outer layer can also be configured to help control where the outer layer will fracture when the wear member is bent onto a curved surface of a machine.

This disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A wear member for attachment to a curved surface of a machine, the wear member comprising:

a body having a pair of opposing first sides and a pair of opposing second sides;

an outer layer of the body having an outer surface, an inner surface, a longitudinal side, and a lateral side, the outer layer including a plurality of channels formed in the outer surface, the channels being parallel to each other and extending between the first sides of the body; and a multi-piece base layer of the body attached to the inner surface of the outer layer and adapted for attachment to the surface of the machine, the base layer being divided into a plurality of base layer pieces, each of the plurality of base layer pieces including a longitudinal side, a lateral side, and at least one interfacing edge, wherein the multi-piece base layer includes, a first base layer end piece having a first edge and a first interfacing edge wherein the first interfacing edge has at least one finger and at least one recess, a second base layer end piece having a second edge and a second interfacing edge wherein the second interfacing edge has at least one finger and at least one recess, at least one base layer center piece having a third interfacing edge and a fourth interfacing edge wherein the third interfacing edge has at least one finger and at least one recess and the fourth interfacing edge has at least one finger and at least one recess, the base layer center piece being positioned between the first end piece and second end piece such that when assembled together each interfacing edge of each base layer center piece is opposite one of the interfacing edge of the first end piece, the interfacing edge of the second end piece, or the third or fourth interfacing edge of one other base layer center piece so as to define at least one gap along and between each pair of opposing interfacing edges;

wherein the longitudinal sides and lateral sides of the base layer pieces result in a longitudinal length and width of the plurality of base layer pieces that when assembled is substantially the same as the longitudinal length and lateral width of the outer layer and wherein the interfacing edges of each of the plurality of base layer pieces are configured with at least one finger and at least one recess, the finger and the recess on the interfacing edge of each of the plurality of base layer pieces being configured such that when the base layer pieces are assembled together, the finger on the interfacing edge of each base layer piece is received in the recess in the interfacing edge of another of the base layer pieces that is complementarily configured and such that the at least one gap between the plurality of pieces creates a zigzag pattern that does not extend parallel to a full length of any of the channels in the outer surface between the first sides of the body wherein the at least one gap of the multi-piece base layer and the channels of the outer layer are adapted to conform to the curved surface of the machine.

2. The wear member of claim 1 wherein the at least one gap between the at least one base layer center piece and the first or second base layer end pieces has a plurality of first gap sections that extend parallel to a portion of one channel in the upper layer, the plurality of first gap sections being separated from each other by second gap sections that do not extend parallel to any portion of any channel in the outer layer.

3. The wear member of claim 2 wherein the first gap sections are defined by longitudinal ends of the fingers and recesses in the interfacing edges of the base layer pieces.

4. The wear member of claim 2 wherein the second gap sections are defined by sides of the fingers and recesses in the interfacing edges of the base layer pieces.

5. The wear member of claim 4 wherein the at least one finger and the at least one recess in the interfacing edge of each of the plurality of base layer pieces extend in a longitudinal direction defined by the pair of second sides of the body.

6. The wear member of claim 1 wherein the base layer is composed of a mild steel alloy material suitable for welding and the outer layer is composed of a white cast iron material not suitable for welding and wherein the base layer is attached to the outer layer by inserting a brazing material between the base layer and the outer layer and by applying a suitable brazing process and wherein the zigzag pattern of the at least one gap of the multi-piece base layer promotes increased heat transfer during the brazing process.

7. The wear member of claim 1 wherein a projection is provided on the at least one finger or the at least one recess of one of the base layer pieces to define a width of the at least one gap.

8. A machine comprising:

an implement assembly, one or more wear members for attachment to one or more curved surfaces of the implement assembly, the one or more wear members comprising:

a body having a pair of opposing first sides and a pair of opposing second sides;

an outer layer of the body having an outer surface, an inner surface, a longitudinal side, and a lateral side, the outer layer including a plurality of channels formed in the outer surface, the channels being parallel to each other and extending between the first sides of the body; and a multi-piece base layer of the body attached to the inner surface of the outer layer and adapted for attachment to the surface of the machine, the base layer being divided into a plurality of base layer pieces, each of the plurality of base layer pieces including a longitudinal side, a lateral side, and at least one interfacing edge, wherein the multi-piece base layer includes, a first base layer end piece having a first edge and a first interfacing edge wherein the first interfacing edge has at least one finger and at least one recess, a second base layer end piece having a second edge and a second interfacing edge wherein the second interfacing edge has at least one finger and at least one recess, at least one base layer center piece having a third interfacing edge and a fourth interfacing edge wherein the third interfacing edge has at least one finger and at least one recess and the fourth interfacing edge has at least one finger and at least one recess, the base layer center piece being positioned between the first end piece and second end piece such that when assembled together each interfacing edge of each base layer center piece is opposite one of the interfacing edge of the first end piece, the interfacing edge of the second end piece, or the third or fourth interfacing edge of one other base layer center piece so as to define at least one gap along and between each pair of opposing interfacing edges;

wherein the longitudinal sides and lateral sides of the base layer pieces result in a longitudinal length and width of the plurality of base layer pieces that when assembled is substantially the same as the longitudinal length and lateral width of the outer layer and wherein the interfacing edges of each of the plurality of base layer pieces are configured with at least one finger and at least one recess, the finger and the recess on the interfacing edge of each of the plurality of base layer pieces being configured such that when the base layer pieces are assembled together, the finger on the interfacing edge of each base layer piece is received in the recess in the interfacing edge of another of the base layer pieces that is complementarily configured and such that the at least one gap between the plurality of pieces creates a zigzag pattern that does not extend parallel to a full length of any of the channels in the outer surface between the first sides of the body wherein the at least one gap of the multi-piece base layer and the channels of the outer layer are adapted to conform to the curved surface of the machine and wherein the zigzag pattern of the at least one gap of the multi-piece base layer is configured to promote increased heat transfer during a brazing process.

* * * * *